US009796073B2

(12) United States Patent
Yaschur et al.

(10) Patent No.: US 9,796,073 B2
(45) Date of Patent: Oct. 24, 2017

(54) HOUSING FOR POWER TOOL

(71) Applicant: Ingersoll-Rand Company, Davidson, NC (US)

(72) Inventors: Jefferey Clifford Yaschur, Doylestown, PA (US); Sean Christian Ely, Flemington, NJ (US)

(73) Assignee: Ingersoll-Rand Company, Davidson, NC (US)

( * ) Notice: Subject to any disclaimer, the term of this patent is extended or adjusted under 35 U.S.C. 154(b) by 1030 days.

(21) Appl. No.: 14/011,404

(22) Filed: Aug. 27, 2013

(65) Prior Publication Data

US 2014/0053688 A1 Feb. 27, 2014

Related U.S. Application Data

(60) Provisional application No. 61/693,635, filed on Aug. 27, 2012, provisional application No. 61/694,062, filed on Aug. 28, 2012.

(51) Int. Cl.

| | |
|---|---|
| ***B25F 5/02*** | (2006.01) |
| ***B25B 21/00*** | (2006.01) |
| ***B25B 13/46*** | (2006.01) |

(52) U.S. Cl.

CPC ..... *B25F 5/02* (2013.01); *B25B 13/461* (2013.01); *B25B 21/00* (2013.01); *B25B 21/004* (2013.01)

(58) Field of Classification Search

None

See application file for complete search history.

(56) References Cited

U.S. PATENT DOCUMENTS

| | | | | |
|---|---|---|---|---|
| 3,443,646 | A | 5/1969 | Baker et al. | |
| 4,368,904 | A | 1/1983 | Lanz | |
| 4,573,370 | A | 3/1986 | Clemens | |
| 4,682,918 | A | 7/1987 | Palm | |
| 4,919,462 | A | 4/1990 | Matsui et al. | |
| 4,974,475 | A | 12/1990 | Lord et al. | |
| 5,142,952 | A | 9/1992 | Putney et al. | |
| 5,251,706 | A * | 10/1993 | Evans | B25B 13/46 173/217 |
| 6,915,721 | B2 | 7/2005 | Hsu et al. | |
| 7,140,451 | B2 * | 11/2006 | Yoshimizu | G09F 3/02 173/162.2 |
| 7,207,394 | B2 * | 4/2007 | Young | B25F 5/00 173/168 |

(Continued)

OTHER PUBLICATIONS

International Search Report for International PCT Application No. PCT/US13/56855 dated Jan. 10, 2014 (2 pages).

(Continued)

*Primary Examiner* — Hemant M Desai
*Assistant Examiner* — Tanzim Imam
(74) *Attorney, Agent, or Firm* — Taft Stettinius & Hollister LLP

(57) ABSTRACT

A tool apparatus includes a substructure at least partially enclosing an electric motor, the electric motor in selective electric communication with a battery, a tool head in mechanical connection with the electric motor, a tool housing defining an inner cavity, wherein the housing is structured to receive the substructure within the inner cavity, and a superstructure having an inner taper configured to receive an outer taper of the tool housing to retain the tool housing relative to the substructure.

19 Claims, 2 Drawing Sheets

(56) References Cited

U.S. PATENT DOCUMENTS

| | | | | |
|---|---|---|---|---|
| 7,475,609 | B2 | 1/2009 | Liaw | |
| 7,604,528 | B2 | 10/2009 | Lo et al. | |
| 7,735,398 | B2 | 6/2010 | Hsu et al. | |
| 7,752,760 | B2 | 7/2010 | Baskar et al. | |
| 2002/0043136 | A1 | 4/2002 | Ladish et al. | |
| 2002/0139547 | A1* | 10/2002 | Nowak, Jr. | B25F 5/00 173/1 |
| 2003/0121676 | A1* | 7/2003 | Ortt | B25F 5/02 173/1 |
| 2003/0159843 | A1 | 8/2003 | Sakai | |
| 2004/0093969 | A1 | 5/2004 | Nielsen | |
| 2004/0148789 | A1* | 8/2004 | Gist | B23D 49/11 30/392 |
| 2005/0090216 | A1* | 4/2005 | Hsu | B25B 21/004 455/184.1 |
| 2007/0056759 | A1* | 3/2007 | Aeberhard | B25F 5/008 173/216 |
| 2007/0256847 | A1* | 11/2007 | Wan | B25F 5/006 173/217 |
| 2008/0025017 | A1* | 1/2008 | Tadokoro | B25B 23/18 362/119 |
| 2008/0190246 | A1* | 8/2008 | Hsu | B25B 23/147 81/57.13 |
| 2009/0014194 | A1* | 1/2009 | Sakai | B25B 21/02 173/93 |
| 2009/0322166 | A1* | 12/2009 | Satterfield | B25F 5/02 310/50 |
| 2010/0326243 | A1 | 12/2010 | Bouchard | |
| 2011/0110734 | A1* | 5/2011 | Scrimshaw | B23B 31/001 408/16 |
| 2011/0126676 | A1 | 6/2011 | Chiang | |
| 2011/0180289 | A1* | 7/2011 | Kumagai | B25F 5/02 173/90 |

OTHER PUBLICATIONS

Written Opinion of the International Searching Authority for International PCT Application No. PCT/US13/56855 dated Jan. 10, 2014 (6 pages).

* cited by examiner

HOUSING FOR POWER TOOL

CROSS-REFERENCE

The present application claims the benefit of U.S. Provisional Patent Application No. 61/693,635 filed on Aug. 27, 2012, and the benefit of U.S. Provisional Patent Application No. 61/694,062, filed on Aug. 28, 2012, both of which are hereby incorporated by reference in their entirety.

TECHNICAL FIELD

The present application relates to power tools and more particularly, but not exclusively, to a housing construction for a power ratchet wrench.

BACKGROUND

A typical power tool is a powered ratchet wrench, which is a right-angle tool that is used to tighten and loosen threaded fasteners. An operator typically uses such a tool in both a powered mode and in a manually-operated mode. In the powered mode, the operator holds the tool handle while the tool delivers the torque to a fastener, using the mechanical power that the tool has delivered. In the manually-operated mode, the operator manipulates the tool like a socket wrench, applying force to the handle, and using the handle as a moment arm for creating and delivering torque to a fastener. Since powered ratchet wrenches are commonly used in this manually-operated mode, provisions are taken to make the handle construction strong enough to withstand the magnitude of force that will potentially be applied to it.

When designing a handle for a battery-operated power tool such as a ratchet wrench, there are unique considerations that steer the design to be different from for example the handle design of air ratchet wrenches. Air ratchet wrenches may have for example a one-piece tubular aluminum handle that is coupled to a steel front ratchet housing. This design may be strong, but it does not lend itself well to a battery-powered ratchet wrench handle due to complexities with assembling the electronic components, mounting the motor, and interfacing with the battery. Similarly, there are also unique considerations that steer the design of a handle for a battery-operated ratchet wrench to be different from the handle design of other battery-powered tools.

SUMMARY

One embodiment of the present application is a unique housing for a battery-powered ratchet wrench that includes a set of half shell type housing members, a substructure, and a reinforcing superstructure. Other embodiments include unique methods, systems, devices, and apparatus to provide for aligning a lock chassis to an orientation and retaining an anti-rotation plate to the lock chassis. Further embodiments, forms, objects, aspects, benefits, features, and advantages of the present application shall become apparent from the description and figures provided herewith.

BRIEF DESCRIPTION OF THE FIGURES

Features of the application will be better understood from the following detailed description when considered in reference to the accompanying drawings, in which.

DETAILED DESCRIPTION OF REPRESENTATIVE EMBODIMENTS

Figure 1:
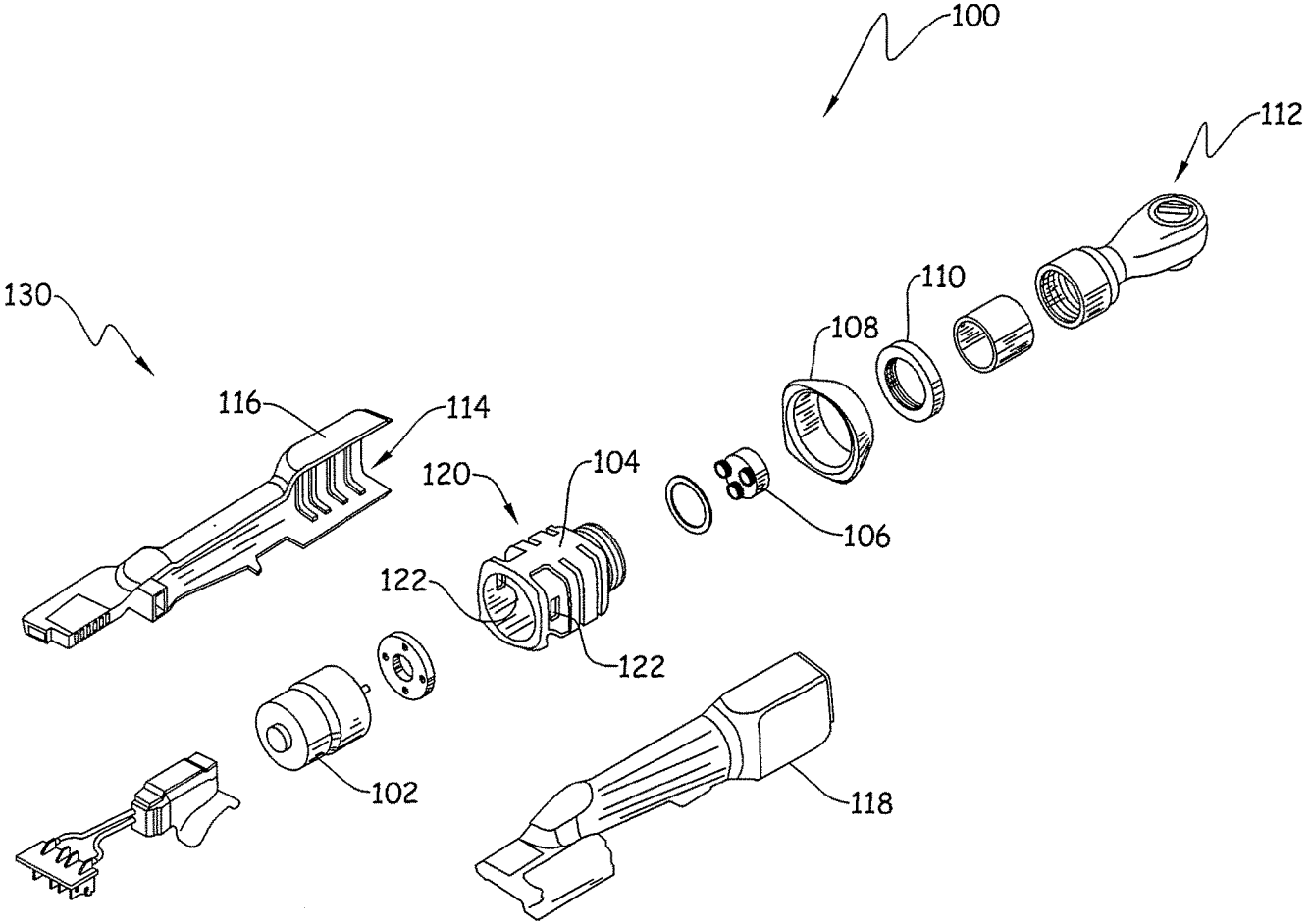
FIG. 1 is an exploded perspective view of a powered ratchet wrench according to an embodiment.

While the present invention can take many different forms, for the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications of the described embodiments, and any further applications of the principles of the invention as described herein, are contemplated as would normally occur to one skilled in the art to which the invention relates.

FIG. 1 shows an exploded perspective view of a powered ratchet wrench 100 according to an embodiment. The wrench 100 includes a motor 102, a tool substructure 104, a gear assembly 106, a tool superstructure 108, a connecting nut 110 such as a spanner nut, and a tool head assembly 112. The tool substructure 104 includes a plurality of radially outward projecting ribs 120. The wrench 100 also includes a clamshell style housing 130 comprising a pair of composite half shells 116, 118 that are assembled over the tool substrate 104 and motor 102. Each half shell 116, 118 includes a plurality of radially inward projecting ribs 114 that mate for example in an interlocking manner with the radially outward projecting ribs 120 of the tool substructure 104. The tool substructure 104 and each half shell 116, 118 of the housing 130 further include vents 122 that are substantially aligned with the motor 102 to provide ventilation for the motor 102, for example in an intake and exhaust type manner.

Figure 2:
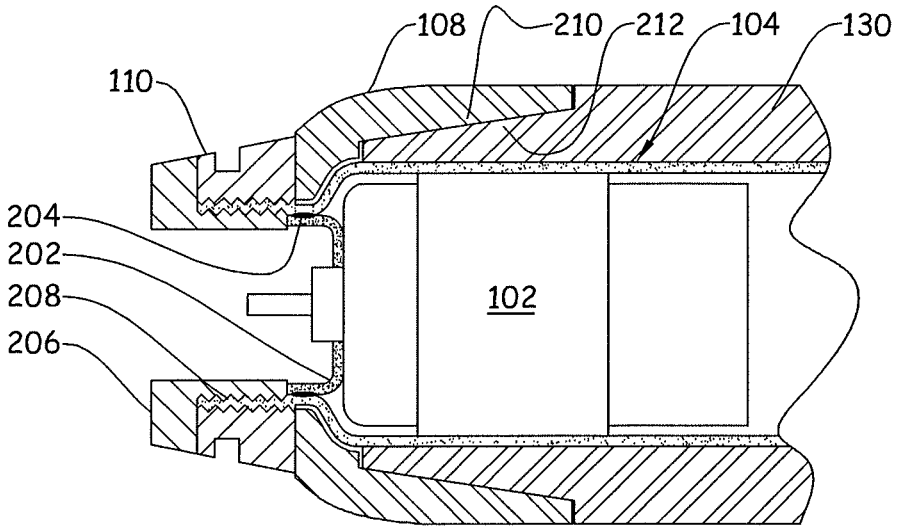
FIG. 2 is a cross sectional view of a portion of the housing of the wrench of FIG.
Figure 3:
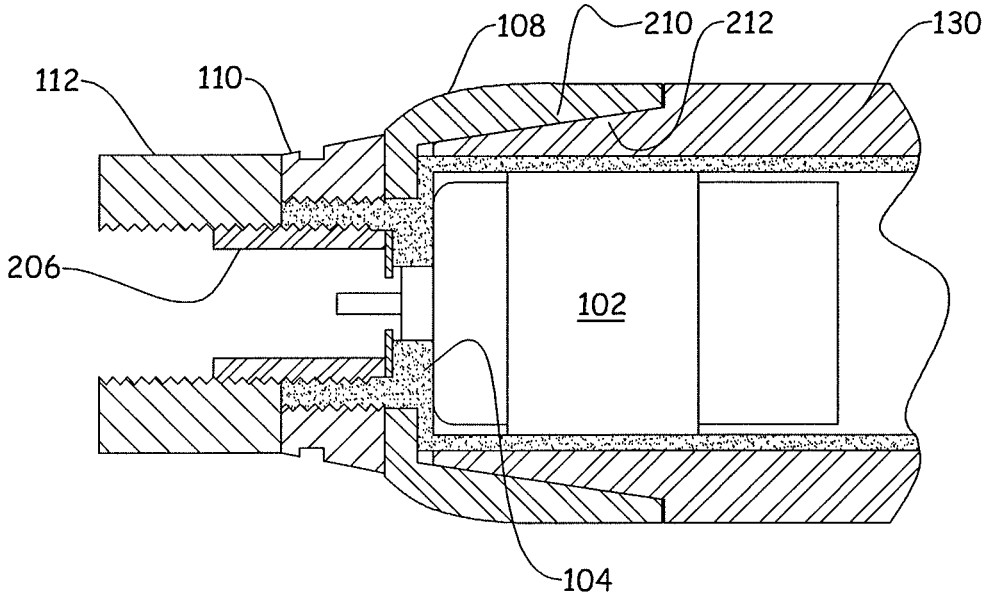
FIG. 3 is a cross sectional view of a portion of a housing of a wrench according to another embodiment.

Turning to FIG. 2, the tool substructure 104 is configured to hold the motor 102 for example as shown. The tool substructure 104 is substantially tubular in shape and may be made of any suitable metal. In an embodiment, the tool substructure 104 is made of a material that is stronger than that of the housing 130, for example steel or the like, and is formed for example by progressive die processing.

Disposed at the axially downstream end of the tool substructure 104 is a ring gear stop 202. The ring gear stop 202 is connected to the inside of the tool substructure 104 by for example a spot weld 204 or spin weld. A ring gear 206 is threaded to an inside thread 208 of the tool substructure 104 into axially abutting relation with the ring gear stop 202.

The tool superstructure 108 comprises a clamp ring in the illustrated embodiment. The tool superstructure 108 may be made of any suitable metal, for example aluminum. In an embodiment the tool superstructure 108 is die casted. The tool superstructure 108 has an inner tapered portion 210 that substantially corresponds to and interfaces with an outer tapered portion 212 of the clamshell style housing 130. The tapered portions 210, 212 of the tool superstructure 210 and the housing 130 facilitate a clamped connection between these components. As shown in FIG. 1, axially downstream from the superstructure 108 is a connecting nut 110 such as a spanner nut, which provides an axial clamping force against the superstructure 210, e.g. clamp ring. With the aid of the interfacing tapered portions 210, 212, the connecting nut 110 compresses the half shells 116, 118 of the housing 130.

Any theory, mechanism of operation, proof, or finding stated herein is meant to further enhance understanding of embodiment of the present invention and is not intended to make the present invention in any way dependent upon such theory, mechanism of operation, proof, or finding. In reading the claims, it is intended that when words such as "a," "an," "at least one," or "at least one portion" are used there is no intention to limit the claim to only one item unless specifically stated to the contrary in the claim. Further, when the language "at least a portion" and/or "a portion" is used the item can include a portion and/or the entire item unless specifically stated to the contrary.

While embodiments of the invention have been illustrated and described in detail in the drawings and foregoing description, the same is to be considered as illustrative and not restrictive in character, it being understood that only the selected embodiments have been shown and described and that all changes, modifications and equivalents that come within the spirit of the invention as defined herein of by any of the following claims are desired to be protected. It should also be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow.

What is claimed is:

1. A system, comprising:

a unitary body substructure including an inner surface that defines an inner cavity structured to receive an electric motor;

a tool housing directly engaged with the substructure, the tool housing including a coupled first half and second half that define an inner portion, wherein the substructure is disposed within the inner portion;

a superstructure including an inner taper that interfaces with an outer taper of the first half of the tool housing and an outer taper of the second half of the tool housing to prevent or resist radially outward movement of the first and second halves of the tool housing from the substructure;

wherein the substructure includes an axially extending portion having an inner thread portion and an outer thread portion;

a nut threaded to the outer thread portion of the substructure and configured to compress the inner taper of the superstructure against the outer taper of the first half of the tool housing and the outer taper of the second half of the tool housing; and a ring gear threaded to the inner thread portion of the substructure.

2. The system of claim 1, further including a rib extending from at least one of the inner portion of the tool housing and an outer surface of the substructure, and a channel located in at least one of the other of the inner portion of the tool housing and the outer surface of the substructure, wherein the substructure is received by the inner portion of the tool housing such that the rib resides in the channel.

3. The system of claim 1, comprising a tool head in mechanical communication with an output of the electric motor.

4. The system of claim 3, wherein the tool head comprises a ratchet.

5. The system of claim 4, wherein the motor and the tool head are configured to selectively operate in an electrically powered mode and a manually powered mode.

6. The system of claim 1, wherein the substructure comprises a first material and the tool housing comprises a second material, the first material being different from the second material.

7. The system of claim 1, wherein at least one of the substructure and the tool housing further include a plurality of vents configured to provide cooling to the electric motor.

8. The system of claim 1, wherein an inner surface of the tool housing includes a plurality of ribs extending therefrom and an outer surface of the substructure includes a plurality of ribs defining respective channels, wherein the ribs of the tool housing are configured to interlock with the channels of the substructure.

9. An apparatus, comprising:

a tool housing including a first half and a second half, wherein the tool housing defines an inner portion and an end taper;

a unitary substructure connected to the inner portion of the tool housing, wherein the substructure defines an inner cavity;

a motor in the inner cavity and configured to provide power to a tool head;

a superstructure having an inner taper configured to interface with the end taper of the tool housing to prevent or resist relative motion between the tool housing and the substructure;

an inner threaded portion and an outer threaded portion located on a first end of the substructure, wherein at least a portion of the first end of the substructure extends axially outside of the tool housing;

a ring gear threadably engaged with the inner threaded portion of the substructure; and a ring gear stop configured to axially abut the ring gear.

10. The apparatus of claim 9, further including a nut threaded to the outer threaded portion of the substructure to apply an axial force to the superstructure such that the inner taper of the superstructure is pressed against the end taper of the tool housing.

11. The apparatus of claim 9, wherein the tool housing includes a first plurality of radially inwardly extending ribs;

the substructure includes a second plurality of radially outwardly extending ribs; and wherein the first plurality of radially inwardly extending ribs interlock with the second plurality of radially outwardly extending ribs to resist or prevent relative axial movement between the tool housing and the substructure.

12. The apparatus of claim 9, wherein the tool head further includes a ratchet.

13. The apparatus of claim 9, wherein the substructure includes a first vent and wherein the tool housing includes a second vent located proximate to the first vent.

14. The apparatus of claim 9, wherein a material of the substructure is different from a material of the tool housing.

15. An apparatus, including;

a unitary substructure at least partially enclosing an electric motor, the electric motor in selective electric communication with a battery;

a tool head in mechanical connection with the electric motor;

a tool housing defining an inner cavity, wherein the tool housing is structured to receive and couple with the substructure within the inner cavity; and a superstructure having an inner taper configured to receive an outer taper of the tool housing to retain the tool housing relative to the substructure;

an inner threaded portion and an outer threaded portion formed on a first end of the substructure; and a nut threaded to the outer threaded portion to apply an axial force to the superstructure such that the inner taper is pressed against the outer taper.

16. The apparatus of claim 15, further including a rib extending from at least one of an inner portion of the tool housing and an outer portion of the substructure, and a channel located in the other of the at least one of the inner portion of the tool housing and the outer portion of the substructure, and wherein the rib is received by the channel.

17. The apparatus of claim 15, wherein the tool head includes a ratchet.

18. The apparatus of claim 15, wherein at least a portion of the first end of the substructure extends axially outside of the tool housing; and a ring gear is threadably engaged with the inner threaded portion of the substructure.

19. The apparatus of claim 15, further including a first plurality of air vents located in the substructure and a second plurality of air vents located in the tool housing, wherein the first plurality of air vents are proximate to the second plurality of air vents.

* * * * *